United States Patent [19]

Baughman et al.

[11] 4,438,854

[45] Mar. 27, 1984

[54] RAILWAY COUPLER

[75] Inventors: Donald L. Baughman; William O. Elliott, both of Pittsburgh, Pa.

[73] Assignee: McConway & Torley Corporation, Pittsburgh, Pa.

[21] Appl. No.: 323,273

[22] Filed: Nov. 20, 1981

[51] Int. Cl.[3] ..... B61G 3/06

[52] U.S. Cl. ..... 213/127; 213/147

[58] Field of Search ..... 213/125, 126, 127, 145, 213/146, 147, 148, 115, 120, 131, 132, 135, 136, 139

[56] References Cited

U.S. PATENT DOCUMENTS

| | | | |
|---|---|---|---|
| 491,589 | 2/1893 | Pooley | 213/139 |
| 1,169,796 | 2/1916 | Geddert | 213/127 |
| 2,695,714 | 11/1954 | Kayler | 213/126 |
| 2,948,415 | 8/1960 | Metzger | 213/148 |

*Primary Examiner*—Robert B. Reeves
*Assistant Examiner*—David F. Hubbuch
*Attorney, Agent, or Firm*—Thomas H. Murray; Clifford A. Poff

[57] ABSTRACT

A railway coupler housing includes a bottom wall section with a thrower hole extending therethrough and spaced from a side wall diverging outwardly from the horn line at the knuckle side of the housing. The side wall continues vertically from the bottom wall section at a rearwardly-spaced relation from the thrower hole along a sufficient height to permit a generally vertical dropping of the thrower within the interior of the coupler head for engaging a trunnion of the thrower in the thrower hole. The thrower in one embodiment has an extended trunnion provided with a diametrically-extending bore to receive a cotter used to retain the thrower in the coupler head. In another embodiment, the end surface of the trunnion includes a tapped hole for receiving a threaded shank of a stop piece. The stop piece includes projecting wing portions that engage with the outer surface of the bottom wall to prevent inadvertent dislodgement of the thrower in the coupler head.

11 Claims, 12 Drawing Figures

RAILWAY COUPLER

BACKGROUND OF THE INVENTION

This invention relates to railroad couplers, and more particularly to improvements to a coupler head for assembling a knuckle thrower therein and/or a retainer to engage with an end portion of a knuckle thrower trunnion for preventing withdrawal of the trunnion from an assembled position in a coupler head.

Couplers for railway vehicles comprise an assembly of parts including a coupler head with spaced-apart pivot lugs at the knuckle side to receive a pivot pin for pivotally attaching a knuckle thereto. A cavity in the coupler head includes a floor wall section with a pivot pin hole to receive a trunnion of a knuckle thrower. The thrower has two oppositely extending legs used to pivot the knuckle in response to tilting movement of a lock. The thrower is an irregularly shaped element usually made as a casting or a forging. In standard A.A.R. coupler heads, Type E and Type F, a projection called a thrower retaining shelf extends from the back wall of the coupler head in the cavity to entrap the thrower against unwanted dislodgement of its trunnion from the thrower hole in the bottom of the coupler head. However, when coupler assemblies are handled during shipment, the thrower can be dislodged from its normally-seated location in the coupler head. Moreover, when the coupler is rotated, as is the practice with certain designs of rotary couplers, the thrower trunnion may fall out of the thrower hole. In other instances, rotary movement of a coupler assembly during installation on a railway car dislodges the thrower from its operative position. The dislodgement of the thrower is usually apparent because of abnormal locking and unlocking operations of the coupler. The coupler must be disassembled for access to the thrower. This is time-consuming, inconvenient and a very undesirable condition to contend with at remote sites.

The thrower retaining shelf may, therefore, fail to provide its intended function when a coupler is rotated. The shelf is obscurely situated as a projection from the back wall in the coupler head adjacent the horn line. The coupler head is a casting requiring loose core pieces to form the thrower retaining shelf. This adds to the cost of the manufacture of the coupler head, particularly when a shelf is angled or deflected from its required site because of wear of the core box equipment or an improperly set core piece. In an E-type coupler, for example, the bottom surface of the shelf is situated about $1\frac{1}{8}$ inches above the floor wall containing the thrower retaining hole. A sharp corner can occur in the back wall of the coupler head between the floor and the thrower retaining shelf, thus creating a weak, low-strength area in the coupler head which cannot be readily detected. The relatively thin wall section of the thrower retaining shelf projects in a cantilevered fashion to varying dimensions of about $1\frac{1}{4}$ inches and greater. An improperly formed shelf may occur due to an unusually cold liquid metal that prevents proper flow of the molten metal during the casting process.

In standard A.A.R. couplers, the existence of the thrower retaining shelf creates an obstruction that necessitates tipping of the thrower in order to align and permit dropping of the trunnion into its support hole in the bottom of the coupler head. Fitting of the trunnion may be required. Assembling of the thrower in the coupler head is usually a tedious undertaking because of the obstruction caused by the thrower retaining shelf. So far as presently known, the thrower retaining shelf has always been considered essential and part of an A.A.R. standard coupler.

SUMMARY OF THE INVENTION

It is an object of the present invention to provide an improved construction and arrangement of parts for retaining a knuckle thrower in a railway coupler.

It is a still further object of the present invention to provide an improved construction for a coupler head of a railway coupler to facilitate assembly and disassembly of parts necessary to form a coupler assembly and in particular a knuckle thrower.

It is a further object of the present invention to provide an improved arrangement of parts to retain a knuckle thrower in a coupler head for cooperative engagement with other parts for operation of a railway coupler.

More particularly, according to the present invention there is provided in a railway coupler knuckle thrower including a knuckle-actuating leg for engaging a thrower pad on a knuckle while pivotally supported by a coupler head, the thrower further including a lock-actuating surface to engage with a lock for pivoting the thrower, the thrower further including a downwardly-extending trunnion for pivotal support of the thrower by a thrower hole in the bottom of the coupler head, the improvement comprising a thrower retainer to engage with an end portion of the trunnion for preventing withdrawal of the trunnion from the thrower hole.

Another aspect of the present invention provides a railway coupler head including a bottom wall section extending forwardly beyond a horn line to a downwardly-inclined back lock chamber wall of a lock chamber, the back lock chamber wall including a generally horizontal floor section with a thrower hole extending therethrough, the coupler head further including a side wall extending forwardly from the horn line at the guard-arm side thereof and a side wall diverging outwardly from the horn line at the knuckle side thereof, the side wall at the knuckle side continuing vertically from a bottom wall section at a rearwardly-spaced relation from the thrower hole in the bottom of the coupler head and at an elevated distance thereabove to permit a generally vertical dropping of the thrower to engage its trunnion in the thrower hole.

In still a further aspect of the present invention there is provided in a coupler for a railway vehicle including a coupler head having a lock-receiving chamber, a knuckle and a knuckle thrower supported by the coupler head for movement between open and locked positions, the head having a guard arm on the side thereof opposite the knuckle, a lock movable within the lock-receiving chamber in the coupler head between thrown, lock set and locked positions, a lock ledge on the rear bottom body portion of the lock to engage the knuckle thrower while the knuckle is in a locked position, the lock being movable upwardly in the chamber to the lock set and thrown positions relative to the knuckle thrower and dropped by gravity towards its locked position when the knuckle is swung to its locked position, a lock lift assembly including a toggle for moving the lock toward its lock set position and movable with the lock towards its lock position, a vertically-extending guide rib in the lock-receiving chamber at the knuckle side of the head, the lock having an upper body portion with a laterally-extending lug for guiding the lock and limiting rearward tilting during downward movement toward the lock position, the lock further including a leg having a lock set seat to engage with a lock set seat surface on the thrower in the lock set position, the thrower having a knuckle-actuating leg for engaging a thrower pad on the knuckle while pivotally supported by the coupler head, the thrower further including a downwardly-extending trunnion for pivotal support by a thrower hole in the bottom of the coupler head, and a thrower retainer to engage with an end portion of the trunnion for preventing withdrawal of the trunnion from the thrower hole.

In one form, the thrower retainer preferably includes a cotter to engage with an opening provided in the end portion of the trunnion. In another form, the thrower retainer includes a stop piece engaged by a threaded connection or the like with an end portion of the trunnion. The stop piece preferably includes a stop bar arranged to project from one or both sides of a shank when threadedly engaged with the trunnion of the thrower.

These features and advantages of the present invention as well as others will be more fully understood when the following description is read in light of the accompanying drawings, in which.

Figure 1:
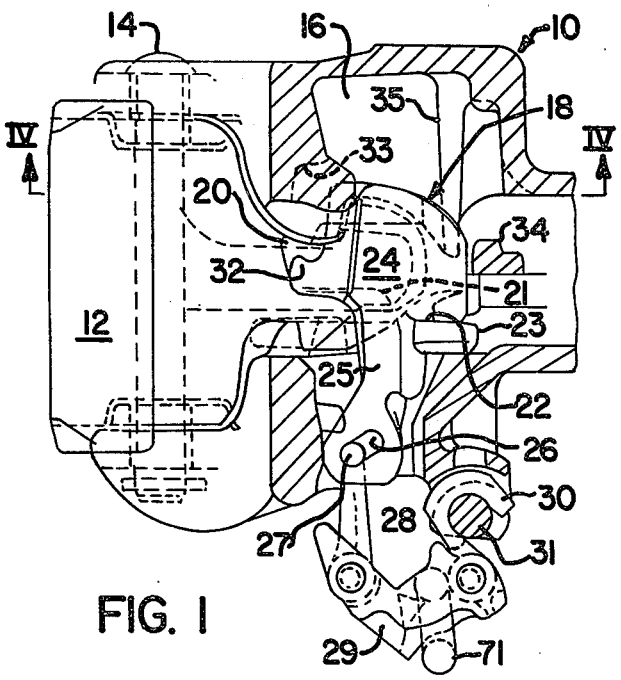
FIG. 1 is a side elevational view of a coupler assembly looking toward the knuckle side, to illustrate the arrangement of parts embodying the present invention with the parts shown in the locked position.

As shown in FIGS. 1–4, an E-type coupler includes a coupler head 10 having a guard arm 11 on one side thereof. A knuckle 12 is pivotally connected by a pivot pin 14 to the head at the side opposite the guard arm. The head 10 has a hollowed interior that includes a lock-receiving chamber 16 with a lock 18 disposed in the chamber. In the closed position of the knuckle, the lock is in its lowermost or locking position as seen in FIG. 1. The lock is interposed between a knuckle tail 20 and a lock wall 44 on the guard-arm side of the coupler head. The lock 18 in its locking position, is supported partly on a support ledge 21 on the knuckle tail and partly on arm 22 of a knuckle thrower 23.

The lock 18 comprises an upper lock body portion 24 and a depending leg portion 25. An elongated slot 26 is provided in the lower end of the leg portion 25 for receiving a horizontal trunnion 27 at the upper end of a lock-lifter toggle 28. The lower end of toggle 28 is pivotally connected to the forward end of a connector 29 which includes a hook-shaped portion 30 supported on a horizontal trunnion 31 on the underside of the coupler head. The connector 29 is actuated by the usual uncoupling rod partial 71 to raise the lock from a locking relation with the knuckle tail 20 whereby the knuckle is free to swing to an open position.

Figure 2:
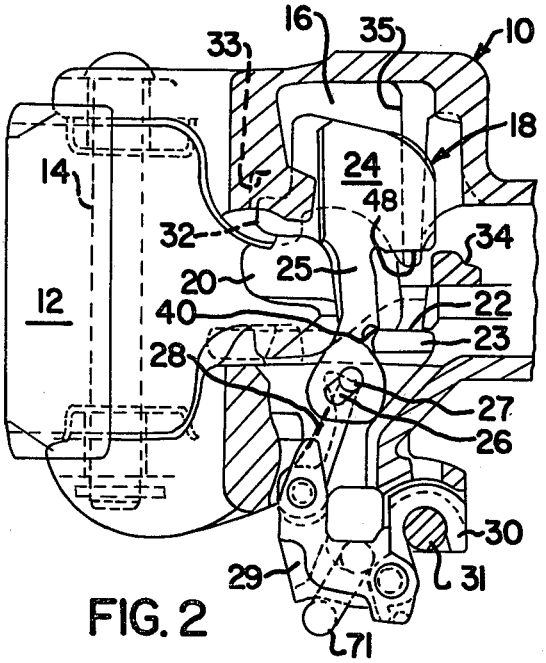
FIG. 2 is a view similar to FIG. 1 but illustrating a knuckle in a closed position with a lock located in the lock set position.
Figure 3:
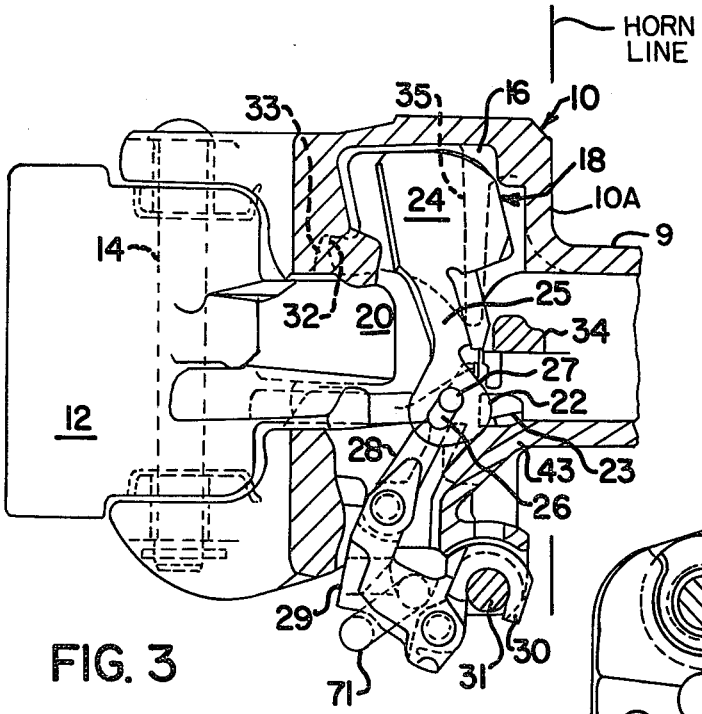
FIG. 3 is a view similar to FIG. 2 but illustrating the knuckle in the open position with the lock raised up to a fully-unlocked position.
Figure 5:
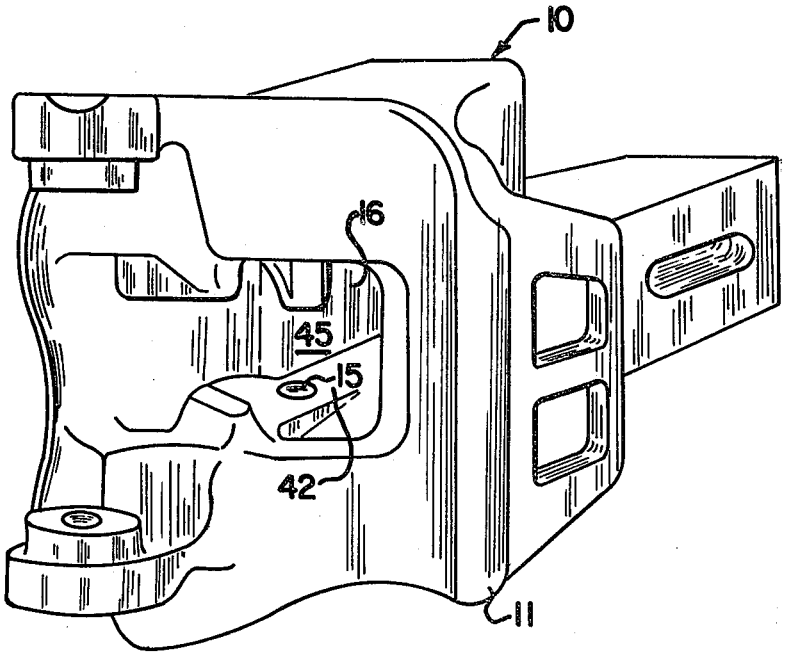
FIG. 5 is an isometric view of the front of an E-type coupler embodying the features of the present invention.
Figure 7:
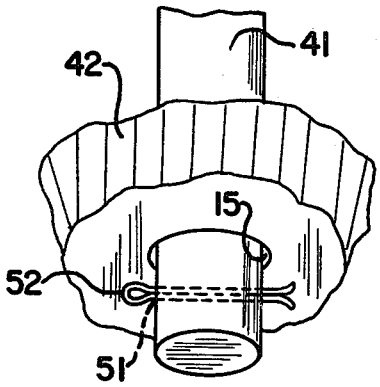
FIG. 7 is a fragmentary isometric view of one embodiment of a thrower retainer according to the present invention.
Figure 6:
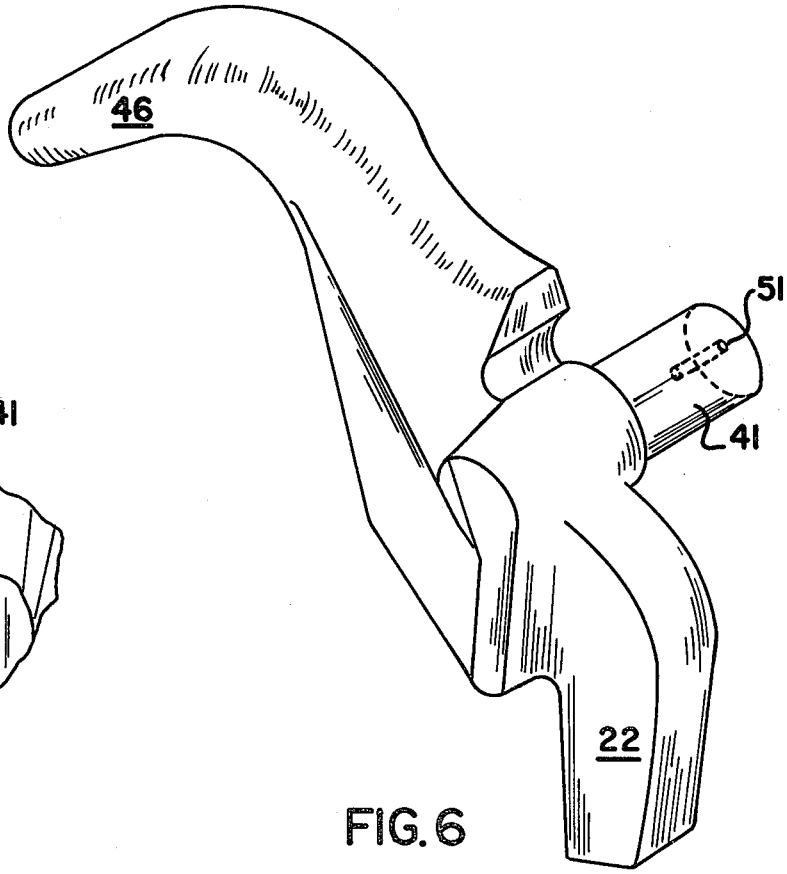
FIG. 6 is an isometric view of a thrower for an E-type coupler embodying the features of the present invention.
Figure 8:
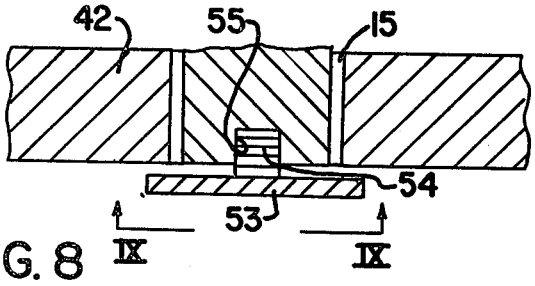
FIG. 8 is a fragmentary sectional view of a further embodiment of the thrower retainer of the present invention.
Figure 10:
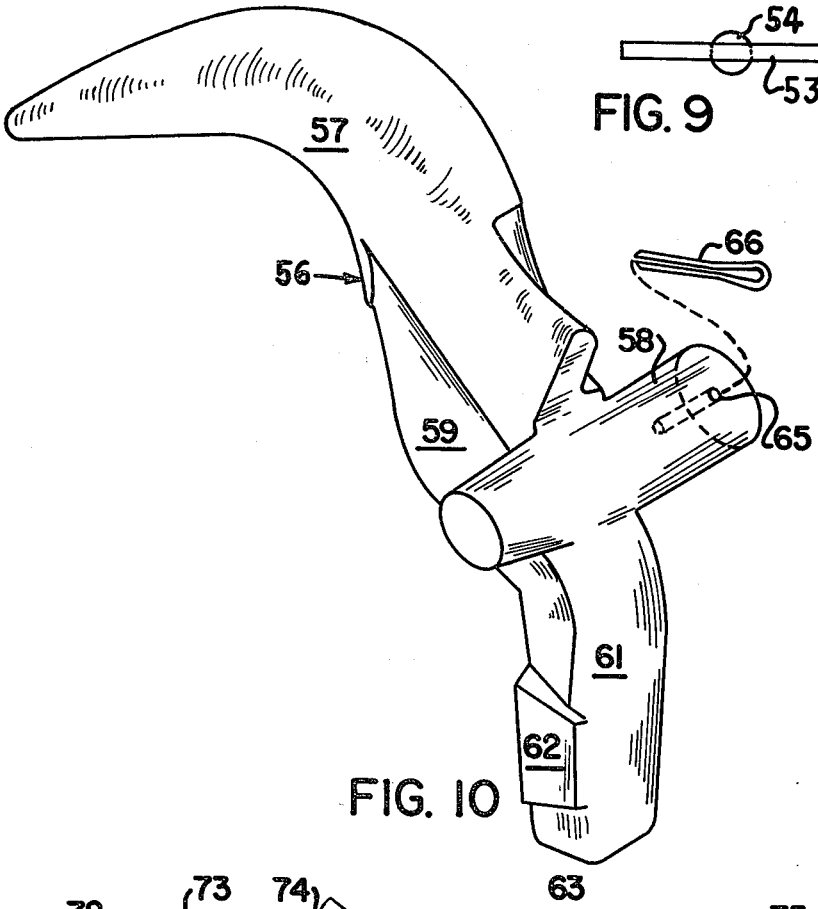
FIG. 10 is an isometric view of a thrower for an F-type coupler embodying the features of the present invention.

In FIG. 3, the knuckle 12 is shown in the open position and lock 18 is in the upper end of chamber 16. The upper body portion 24 of the lock is above the top of the knuckle tail 20. The position of the lock 18 shown in FIG. 2 is referred to in the art as the lock-set position with the lock set seat 40 of the lock leg 25 resting on the top face of leg 22 of thrower 23. The knuckle 12 can be revolved about the pin 14 to an open position as typically occurs when the nose of a knuckle of a mating coupler exerts a forward pull as a leading railway car is pulled away. The lock is lifted by actuating the linkage coupled to the bottom thereof for raising it to an unlocked position, shown in FIG. 3, where a fulcrum 32 on the front side of the lock engages a shoulder 33 in the front wall of the coupler head. The continued application of a thrust forces the lock to rotate about fulcrum 32 driving the leg 25 of the lock rearwardly. The leg of the lock engages the leg 22 of thrower 23 causing rotation thereof. The thrower as shown in FIGS. 6 and 10 has a downwardly-extending trunnion 41 and 58, respectively, supported for pivotal movement by a thrower hole 15. Hole 15 extends through the bottom wall section 42 of the coupler head as shown in FIGS. 5, 7 and 8. The bottom wall section 42 extends forwardly beyond the usual, well-known horn line to a downwardly-inclined back lock chamber wall 43. The horn line is defined by a line extending along surface 10A and passing through the head 10 at the junction with a coupler shank 9.

Figure 4:
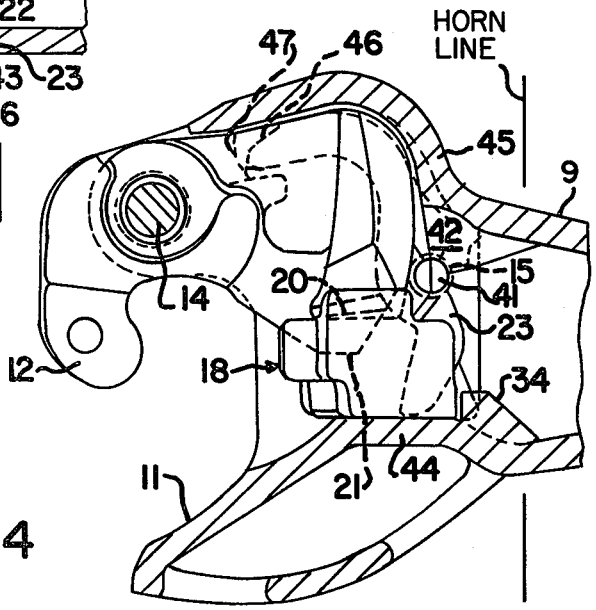
FIG. 4 is a horizontal sectional view taken along line IV—IV of FIG. 1.

As best shown in FIGS. 4 and 5, the coupler housing 10 includes a side wall 44 extending forwardly from the horn line at the guard-arm side. A side wall 45 diverges outwardly from the horn line at the knuckle side. According to the present invention, the side wall 45 is smooth, continuous, continues without obstruction along a vertical height from the bottom wall section 42 at a rearwardly-spaced relation from the thrower hole 15 along a sufficient height to permit a generally vertical dropping of the thrower within the interior of the head for engaging the trunnion in the thrower hole. This obviates the practice in the past of angling the thrower in a downwardly-sloping manner to engage the trunnion with the thrower hole. In the past, the thrower hole was obscured by an overlying thrower retaining shelf projecting from the side wall 45.

As described above, the thrower is caused to rotate by the rearward movement of the lock leg 25. The thrower has a knuckle-actuating leg 46 extending in an opposite direction from the trunnion with respect to leg 22. An end portion of the knuckle-actuating leg 46 has a hook-like shape which when operatively arranged in the coupler moves into engagement with a thrower pad 47 on the bottom portion of the knuckle 12. Rotary movement of the thrower, in turn, produces movement of the knuckle about pin 14 into an open position. Upon closing of the knuckle from the unlocked as well as the lock-set position, the lock will drop by gravity to lock the knuckle as shown in FIG. 1. In the locking position, the lock is retained against rearward displacement by a lug 34 which projects laterally into the lock chamber 16 from the side wall 44 at the guard-arm side of head 10. The lug 34 is directly rearward of the upper lock body portion 24. A vertically-extending lock guide rib 35 shown in FIGS. 1, 2 and 3 extends into chamber 16 from the top wall of the coupler head at the knuckle side. The inwardly-facing surface of the rib terminates in close proximity to the side wall of the upper lock body portion directed toward the knuckle side of the coupler housing. The rib 35 limits lateral displacement of the lock during vertical travel within the lock-receiving chamber.

The lock leg 25 includes at its rear surface a lock-set seat 40 which is a slightly tapered horizontal ledge located about midway between the bottom end of the leg and a thrower seat 48 which is also a slightly tapered horizontal ledge at the back surface of the lock. The thrower seat typically defines a line of demarcation between the depending leg 25 and the upper lock body portion 24.

Figure 9:
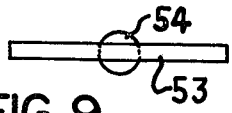
FIG. 9 is a view taken along line IX—IX of FIG. 8.

As shown in FIGS. 6 and 7, the trunnion 41, according to one embodiment, has an extended length and an end portion thereof which projects from the bottom wall of the coupler and includes a diametrically-extending hole 51. Hole 51 is situated to receive a cotter 52. The head and bent-over end portions of the cotter form a thrower retainer that will engage with the end portion of the trunnion for preventing withdrawal of the thrower from the thrower hole. FIGS. 8 and 9 illustrate a further embodiment of a thrower retainer according to the present invention. In this embodiment, the thrower retainer includes a stop piece 53 having a threaded shank 54 secured to the stop piece which takes the form of a crossbar. The shank and crossbar form a T-shaped configuration arranged so that oppositely extending portions of the crossbar can engage the undersurface of the bottom wall 42 of the coupler when the shank is threadedly engaged with a tapped hole 55. Hole 55 is located in the end face of the trunnion of the thrower. The length of the trunnion does not need to be extended as in the embodiment of FIGS. 6 and 7.

FIG. 10 illustrates a thrower 56 for an F-type coupler. This thrower has distinct similarities with the thrower shown in FIG. 6 for an E-type coupler. Essentially the thrower 56 includes a knuckle-actuating leg 57 with a hook-shaped portion extending from a downwardly-projecting trunnion 58. Adjacent the trunnion 58 there is a lock-leg guide surface 59. Projecting from the trunnion at a generally opposite direction from the knuckle-actuating leg is a leg 61 having a raised pad forming a lock seat 62 and a lock-actuating surface 63. The trunnion 58 is extended so that it projects through a thrower hole 64 (FIG. 11) in the bottom wall of the F-type coupler head in essentially the same manner as illustrated in FIG. 7. The projected end portion of the trunnion has a diametrically-extending hole 65 into which there is received a cotter 66. It is to be understood that the stop piece shown in FIGS. 8 and 9 may be used to retain the thrower of FIG. 10 in its operative position within the F-type coupler head.

Figure 11:
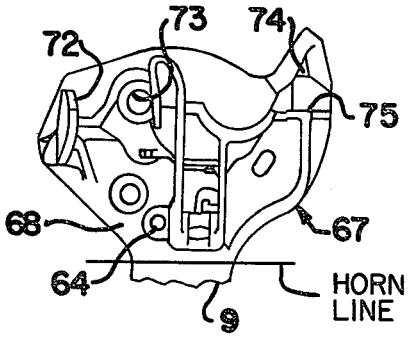
FIG. 11 is a plan view of the bottom of an F-type coupler assembly.
Figure 12:
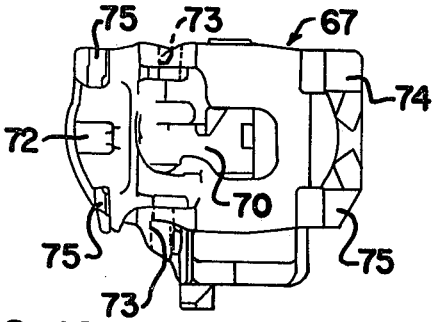
FIG. 12 is a front elevational view of the coupler shown in FIG. 11.

In FIGS. 11 and 12, an F-type coupler head is shown. The F-type coupler includes a head 67 with a bottom wall 68 through which the thrower hole 64 extends to the hollowed interior of the coupler head. The present invention provides that the thrower hole opens out of the bottom wall of the coupler at a spaced, outward relation from a side wall 70 which is a smooth continuous surface free of the usual thrower retaining lug so that the thrower can be easily positioned in the hollow interior of the coupler head. The trunnion can be aligned with the thrower hole without tilting or intricate manipulation. The F-type coupler head has certain characteristic features which distinguish it from an E-type coupler head. These features include an interlocking wing pocket 72 at the knuckle side of the coupler head which includes pivot pin hole 73. Opposite the knuckle side, there is a guard arm 74. Both the guard-arm side and the knuckle side have lateral aligning surfaces 75.

Although the invention has been shown in connection with certain specific embodiments, it will be readily apparent to those skilled in the art that various changes in form and arrangement of parts may be made to suit requirements without departing from the spirit and scope of the invention.

We claim as our invention:

1. A railway coupler knuckle thrower including a knuckle-actuating leg for engaging a thrower pad on a knuckle while pivotally supported by a coupler head, said thrower further including a lock-actuating surface to engage with a lock for pivoting said thrower, said thrower further including a downwardly-extending trunnion for pivotal support of the thrower by a thrower hole in a bottom wall of said coupler head, the improvement comprising a thrower retainer engaged with an end portion of said trunnion and arranged outside said coupler head for preventing withdrawal of the trunnion from the thrower hole.

2. The railway coupler knuckle thrower according to claim 1 wherein said thrower retainer includes a cotter, and wherein said end portion of said trunnion extends from said coupler head and includes means for supporting said cotter.

3. The railway coupler knuckle thrower according to claim 1 wherein said thrower retainer includes a stop piece, and wherein said end portion of said trunnion including means for supporting said stop piece.

4. The railway coupler knuckle thrower according to claim 3 wherein said means for supporting includes a threaded hole in the end of said trunnion.

5. The railway coupler knuckle thrower according to claim 3 wherein said stop piece includes a shank, and a stop bar projecting from said shank.

6. In a railway coupler housing including a bottom wall section extending forwardly beyond a horn line to a downwardly-inclined back lock chamber wall of a lock chamber, said back lock chamber wall including a floor section with a thrower hole extending therethrough, said coupler housing further including a guard arm on a guard arm side and a knuckle on an oppositely spaced knuckle side, a side wall extending forwardly from the horn line at the guard-arm side, and a side wall diverging outwardly from the horn line at the knuckle side and continuing vertically from a bottom wall section at a rearwardly-spaced relation from the thrower hole along a sufficient height to permit a generally vertical dropping of a thrower within the interior of the coupler head for engaging a trunnion of the thrower in the thrower hole, the combination therewith of a thrower having an elongated trunnion for pivotal support by said thrower hole, and a thrower retainer arranged outside said lock chamber to engage with the end portion of the trunnion for preventing withdrawal of the trunnion from the thrower hole.

7. The combination according to claim 6 wherein said thrower retainer includes a cotter, and wherein the end portion of said trunnion including means for supporting said cotter.

8. The combination according to claim 6 wherein said thrower retainer includes a stop piece, and wherein the end portion of said trunnion including means for supporting said stop piece.

9. The combination according to claim 8 wherein said means for supporting includes a threaded hole in the end portion of said trunnion engaged with said thrower retainer.

10. The combination according to claim 8 wherein said stop piece includes a shank having a stop bar projecting from said shank for engaging said floor section outside said lock chamber.

11. A coupler for a railway vehicle including a coupler head having a lock-receiving chamber, a knuckle and a knuckle thrower supported by the coupler head for movement between open and locked positions, the head having a guard arm on the side thereof opposite the knuckle, a lock movable within the lock-receiving chamber in the coupler head between thrown, lock set and locked positions, a lock ledge on the rear bottom body portion of the lock to engage the knuckle thrower while the knuckle is in a locked position, the lock being movable upwardly in the chamber to the lock set and thrown positions relative to the knuckle thrower and dropped by gravity towards its locked position when the knuckle is swung to its locked position, a lock lift assembly including a toggle for moving the lock toward its lock set position and movable with the lock towards its locked position, a vertically-extending guide rib in the lock-receiving chamber at the knuckle side of the head, the lock having an upper body portion with a laterally-extending lug for guiding the lock and limiting rearward tilting during downward movement toward the locked position, the lock further including a leg having a lock set seat to engage with a lock set seat surface on the thrower in the lock set position, the thrower having a knuckle-actuating leg for engaging a thrower pad on the knuckle while pivotally supported by the coupler head, the thrower further including a downwardly-extending trunnion for pivotal support by a thrower hole in the bottom of the coupler head, and a thrower retainer to engage with an end portion of the trunnion for preventing withdrawal of the trunnion from the thrower hole.

* * * * *